US005875669A

United States Patent [19]

Takeda et al.

[11] Patent Number: 5,875,669

[45] Date of Patent: Mar. 2, 1999

[54] ROLLING METHOD AND ROLLING FACILITY FOR MANUFACTURING STEEL BARS FOR CONCRETE REINFORCEMENT

[75] Inventors: Ryo Takeda; Hidenori Kondo; Tomoyasu Sakurai, all of Kurashiki, Japan

[73] Assignee: Kawasaki Steel Corporation, Kobe, Japan

[21] Appl. No.: 762,054

[22] Filed: Dec. 9, 1996

[51] Int. Cl.[6] ..... B21H 8/02

[52] U.S. Cl. ..... 72/194; 72/198

[58] Field of Search ..... 72/194, 198, 187, 72/224; 52/740.03, 740.04, 740.05

[56] References Cited

U.S. PATENT DOCUMENTS

| | | | |
|---|---|---|---|
| 3,186,206 | 6/1965 | Gillberg | 72/194 |
| 4,034,587 | 7/1977 | Schwarz | 72/194 |

FOREIGN PATENT DOCUMENTS

| | | | |
|---|---|---|---|
| 0 399 910 | 11/1990 | European Pat. Off. | 72/194 |
| 57-59763 | 12/1982 | Japan | 72/194 |
| 2-34208 | 2/1990 | Japan | 72/224 |

*Primary Examiner*—Lowell A. Larson
*Attorney, Agent, or Firm*—Oliff & Berridge PLC

[57] ABSTRACT

The present invention provides a rolling method and apparatus for manufacturing concrete-reinforcing steel bars, wherein the invention provides for obtaining various concrete-reinforcing steel bars satisfying the required specifications for knot height while using the same finishing rolls even if the diameters of the final product steel bars are different. According to the present invention, two pairs of rolls (total of four rolls) each having a roll caliber and one or more knotting round calibers are used for the final finishing pass, and the two pairs of rolls are arranged to exert rolling pressures in two orthogonal directions on a raw material S.

9 Claims, 8 Drawing Sheets

ROLLING METHOD AND ROLLING FACILITY FOR MANUFACTURING STEEL BARS FOR CONCRETE REINFORCEMENT

BACKGROUND OF THE INVENTION

1. Field of the Invention

The present invention relates to a rolling method and apparatus for manufacturing steel bars used for concrete reinforcement or the like. In particular, the present invention relates to a rolling method by which various steel bars for concrete reinforcement (hereinafter, referred to as concrete-reinforcing steel bars) having high dimensional accuracies, such as knot height can be obtained using the same finishing rolls regardless of the diameters of the steel bars of final products. Concrete-reinforcing steel bars of various types, including non-lib type, 2-lib type, and 4-lib type, can be manufactured. The present invention is particularly suitable for manufacturing concrete-reinforcing steel bars of the 4-lib type.

2. Description of the Related Art

In conventional rolling methods for manufacturing concrete-reinforcing steel bars, a raw material is rolled through a series of rolling stands in an early stage of the process so as to form an oval cross section. After that, the raw material, now in oval form, is rolled with a final finishing rolling stand equipped with a pair of rolls (total of two rolls) so as to form knots on the circumferential surface of the raw material.

FIG. 1 is an elevation view of conventional finishing rolls in a final finishing rolling stand. Each of the finishing rolls $R_1$ and $R_2$ has a roll caliber 1 which has a circular arc cross section, one or more grooves 2 to form knots (hereinafter, referred to as knotting round calibers) formed on the roll caliber at a pre-determined pitch in the circumferential direction of the roll and one groove 6 to form a lib (hereinafter, referred to as lib-forming groove) formed on the roll caliber bottom in the circumferential direction of the roll. A raw material S which has been rolled through a aeries of rolling stands in an earlier stage of the rolling process, providing an oval cross section is rolled with this final finishing rolling stand.

FIG. 2 contains schematic drawings showing the shape of one example of a final product 4-lib type steel bar S. The final product, i.e. a round rod material, has knots 3 on its circumferential surface. Additionally, the round rod material has four libs 4 on the surface along the axis direction which are formed due either to overfill of the raw material S from between the rolls $R_1$ and $R_2$ or to metal flow to the lib-forming groove. Such a concrete-reinforcing steel bar is specified by:

I unit weight;

II diameter D excluding the heights of the knots 3 and libs 4; and

III design of the knots 3, namely, i) height t of the knots 3, ii) distance L between knots 3 next to each other in the axis direction, and iii) distance d between knots 3 next to each other in the circumferential direction. In particular, the tolerance range for the height t of the knots 3 is strictly specified.

In the prior art, when concrete-reinforcing steel bars which have the same knot height but different diameters are manufactured, so that all the steel bars satisfy the strict specifications, the rolls of the rolling stand must be changed from rolls fixed for a first diameter to rolls fixed for a second diameter. If a concrete-reinforcing steel bar having a small diameter is manufactured by rolling with a 2-roll rolling stand fixed for a diameter larger than that of the steel bar being manufactured, the roll gap between finishing rolls $R_1$ and $R_2$ in the rolling stand must be changed from a value $H_1$ to a value $H_2$ smaller than $H_1$, as shown in FIG. 8. In this case, the knot height can not be controlled in the direction perpendicular to the direction of the roll gap, and therefore, each knot formed will have an irregularity in height relative to the circumferential direction. As a result, the produced steel bar will not satisfy the required specifications. Further, when a 4-lib type concrete-reinforcing steel bar is manufactured by rolling with a 2-roll rolling stand, breakage frequently occurs in a corner portion formed at the bottom of the caliber of each roll. Accordingly, steady rolling cannot be completed due to wear of the rolls.

SUMMARY OF THE INVENTION

The present invention addresses the above-described problems in the prior art. Accordingly, the present invention provides a rolling method and apparatus for manufacturing concrete-reinforcing steel bars, wherein the method makes it possible to obtain various diameter concrete-reinforcing steel bars satisfying the required specifications for knot height while using the same finishing rolls.

Additionally, the present invention provides a method and apparatus for manufacturing concrete-reinforcing steel bars which reduces the time required to manufacture steel bars having various diameters.

Additionally, the present invention provides a method and apparatus for manufacturing concrete-reinforcing steel bars which reduces the number of rolling stands necessary to manufacture steel bars having various diameters.

The present invention provides a rolling method for manufacturing a concrete-reinforcing steel bar, comprising:

rolling a raw material in a final finishing rolling stand with rolls each having a roll caliber and one or more knotting round calibers on the roll caliber at a pre-determined circumferential pitch so as to form knots on the circumferential surface of the raw material, wherein the final finishing rolling stand includes two pairs of rolls each having the roll caliber and one or more knotting round calibers, and wherein the two pairs of rolls are arranged to exert rolling pressures in two orthogonal directions on the raw material.

In the method of the present invention, knots are is formed on the circumferential surface of a raw material in the final finishing rolling process using a rolling stand equipped with two pairs of rolls instead of a rolling stand equipped with one pair of rolls as employed in conventional methods. According to the present invention, various concrete-reinforcing steel bars which satisfy the required specifications for knot height can be obtained using the same final finishing rolls even if the diameters of the final product steel bars are different. In other words, the present invention can extend the so called size-free range in the rolling process.

FIG. 3 illustrates an example of a final finishing rolling stand of the present invention comprising two pairs of rolls. In such a final finishing rolling stand, raw materials are rolled under rolling pressures in two orthogonal directions with two pairs of rolls each having a roll caliber and knotting round calibers. If this final finishing rolling stand is initially set for producing steel bars having a first diameter and it is subsequently desired to manufacture a concrete-reinforcing steel bar having a second diameter different from the first diameter, the two roll gaps $H_{11}$ and $H_{12}$, which are directionally perpendicular to each other can be changed to new roll gaps $H_{21}$ and $H_{22}$, respectively, which are appropriate for the second diameter, which is different from the first diameter. Since the knot height is controlled in two orthogonal directions, each knot to be formed has excellent regularity in height throughout the circumferential direction as compared with knots formed by conventional 2-roll methods. Accordingly, various concrete-reinforcing steel bars which have different diameters can be produced with the same final finishing rolling stand while satisfying the required specifications for knot height can be obtained by only adjusting the roll gaps without changing the rolls.

DESCRIPTION OF THE PREFERRED EMBODIMENT

The present invention will be further illustrated with examples below while referring to drawings.

Figure 4:
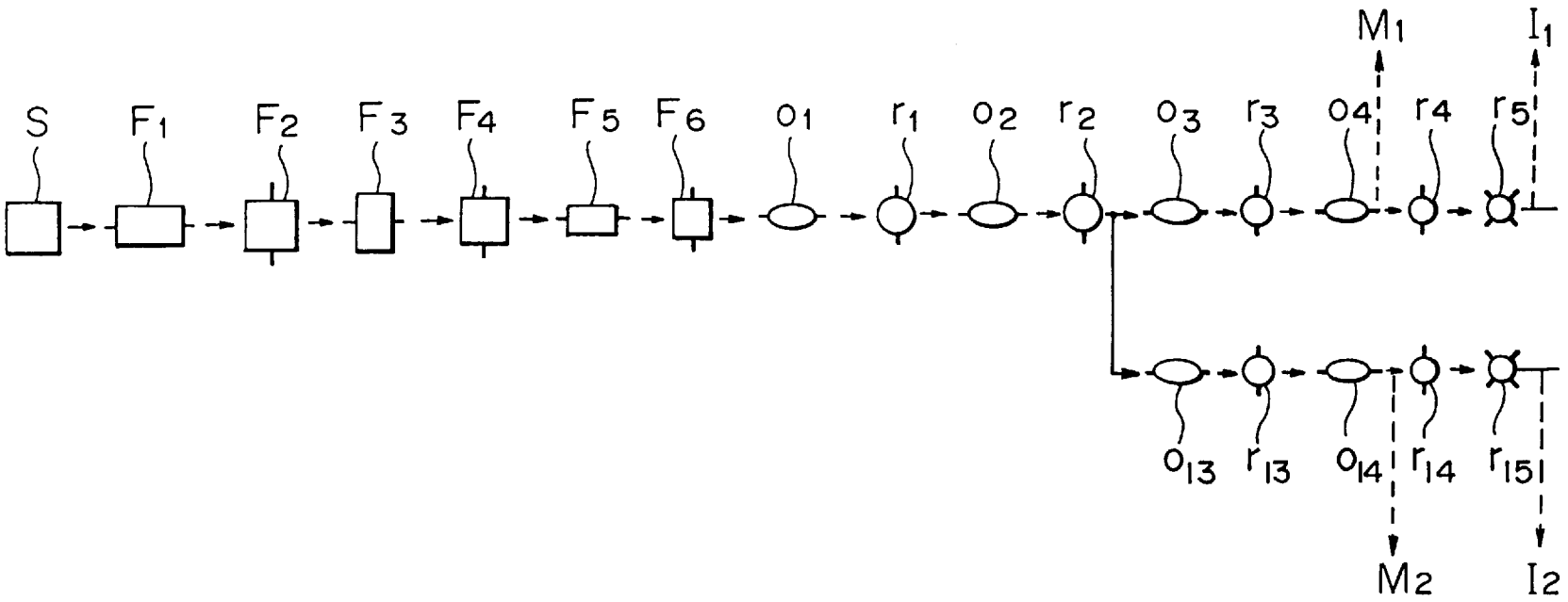
FIG. 4 shows a pass schedule employed in an example for manufacturing concrete-reinforcing steel bars.

FIG. 4 shows a pass schedule employed in the following examples. In this drawing, a raw material S is fed to a series of rolling stands. Each code address indicates a rolling stand and the pattern indicated by each code address represents the shape of the caliber in each rolling stand. Initially, the raw material S has a square cross section and is rolled with rolling stands F, to $F_6$ which are equipped with flat rolls. In this step, the raw material is rolled under pressure alternating in direction between vertical and horizontal, and the cross sectional area of the raw material gradually becomes smaller. After that, the resulting raw material is rolled alternately with two types of rolling stands, namely, rolling stands $O_1$ to $O_4$ equipped with rolls each having an oval caliber (hereinafter referred to as oval-type rolling stands), and rolling stands $r_1$ to $r_4$ equipped with rolls each having a round caliber (hereinafter referred to as round-type rolling stands). In this step, the raw material is rolled under pressure alternating in direction between vertical and horizontal, and the cross section of the raw material becomes circular. Finally, the resulting raw material is rolled with a rolling stand $r_5$ equipped with two pairs of rolls each having a round caliber and knotting round calibers. The rolling stand $r_5$ provides rolling pressures in two orthogonal directions. As a result, the final product concrete-reinforcing steel bar is provided with knots and libs on its circumferential surface. When a concrete-reinforcing steel bar having another diameter is desired, the oval-type rolling stands $O_3$ and $O_4$ and the round-type rolling stands $r_3$ to $r_5$ are replaced with the oval-type rolling stands $O_{13}$ and $O_{14}$ and the round-type rolling stands $r_{13}$ to $r_{15}$, respectively, which are fixed for the other diameter, as detailed below.

Figure 3:
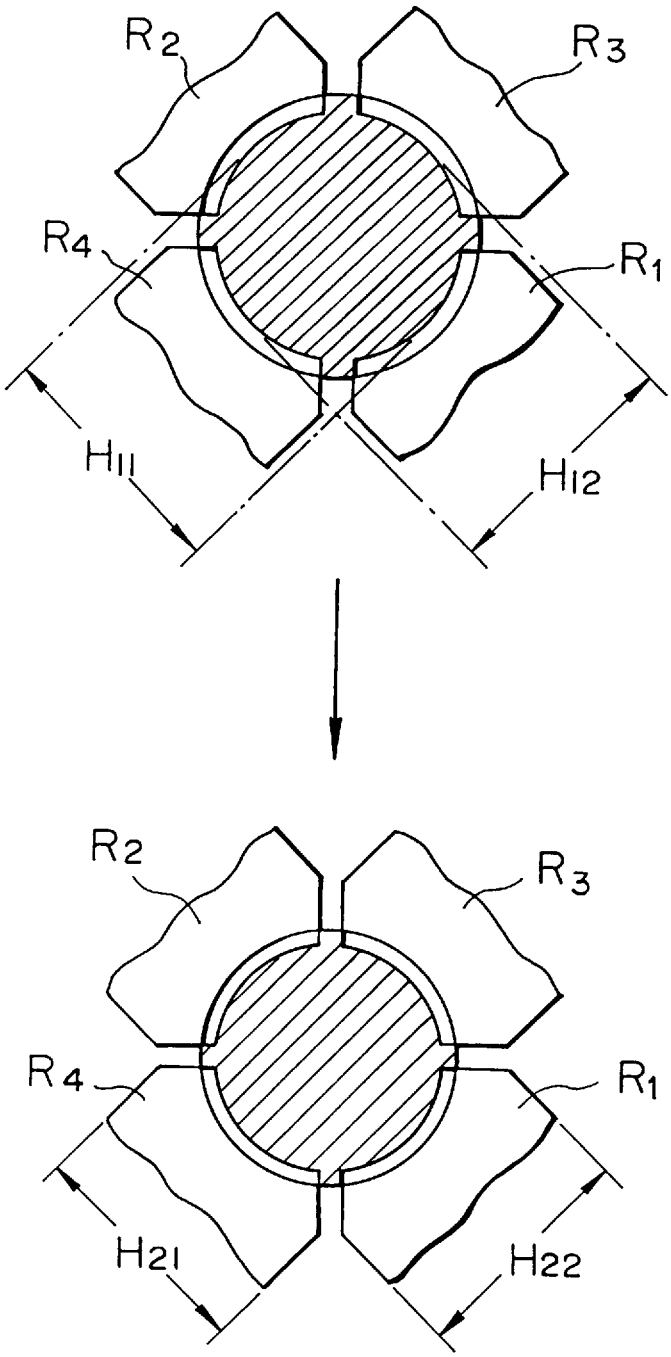
FIG. 3 shows a principal portion of a final finishing rolling stand according to the present invention which comprises two pair of rolls (total of four rolls)

As one example, a concrete-reinforcing steel bar $I_1$ having a diameter of 22 mm is manufactured as follows: A round rod material $M_1$ having an outer diameter of 29.0 mm is obtained by rolling with a series of 2-roll rolling stands $F_1$ to $F_6$, $O_1$ to $O_4$, and $r_1$ to $r_4$, and the round rod material $M_1$ is then rolled with a 4-roll rolling stand $r_5$ equipped with rolls each having a round caliber. As another example, a concrete-reinforcing steel bar $I_2$ having a diameter of 25 mm is manufactured as follows: A round rod materials $M_2$ having an outer diameter of 26.0 mm is obtained by rolling with a series of 2-roll rolling stands $F_1$ to $F_6$, $O_1$ and $O_2$, $r_1$ to $r_1$, $O_{13}$ and $O_{14}$, and $r_{13}$ to $r_{14}$, and the round rod material $M_2$ is then rolled with a 4-roll rolling stand $r_{15}$ which is the same as the rolling stand $r_5$ except that the roll gaps are altered, as illustrated in FIG. 3.

Figure 1:
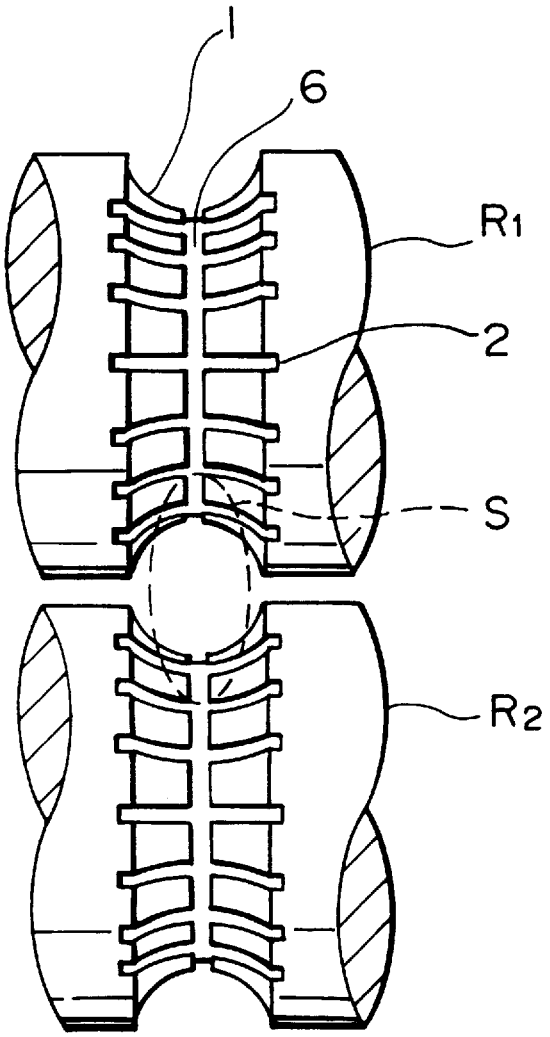
FIG. 1 (RELATED ART)
FIG. 1 shows an elevation view of conventional rolls used for a final finishing pass.
Figure 2A:
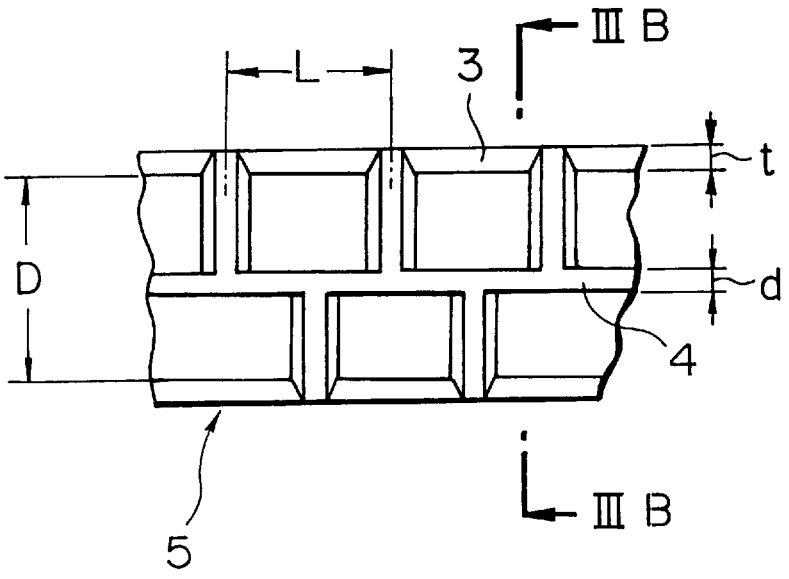
FIG. 2A shows a partial side-view of one example of a 4-lib type concrete-reinforcing steel bar.
Figure 2B:
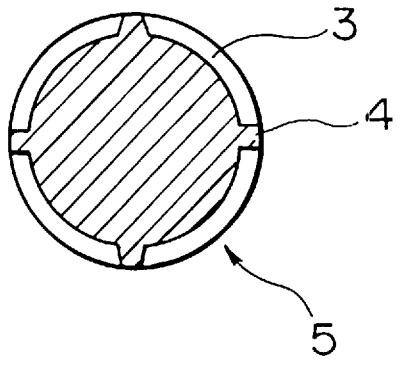
FIG. 2B shows a cross sectional view taken along the line IIIB—IIIB in FIG. 2A.

Similar to the rolls $R_1$ and $R_2$ shown in FIG. 1, each of the rolls used in 2-roll rolling stands $r_1$ to $r_4$ had on its circumferential surface a roll caliber 1 having a circular arc cross section. On the roll caliber 1, knotting round calibers 2 perpendicular to the circumferential direction of the roll were carved with a pre-determined width. Incidentally, these knotting round calibers 2 were carved at a pitch of 14.5 mm along the circumferential direction of the roll caliber 1.

Figure 5A:
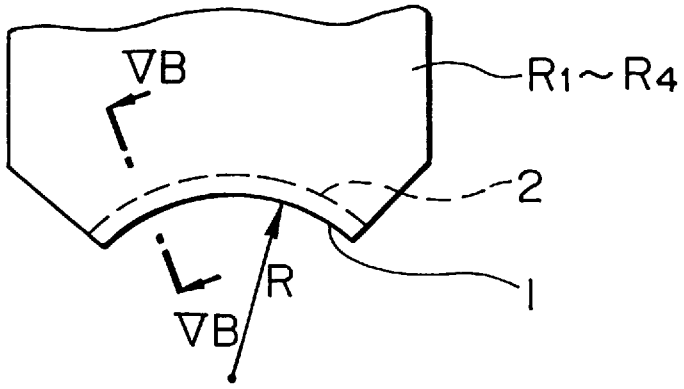
FIG. 5 shows a roll caliber and a knotting round caliber of a roll used in the example illustrated in FIG. 2, FIG. 5A Indicating the radius of curvature of the roll caliber, and FIG. 5B being a cross sectional view taken along the line VB—VB in FIG. 5A.
Figure 5B:
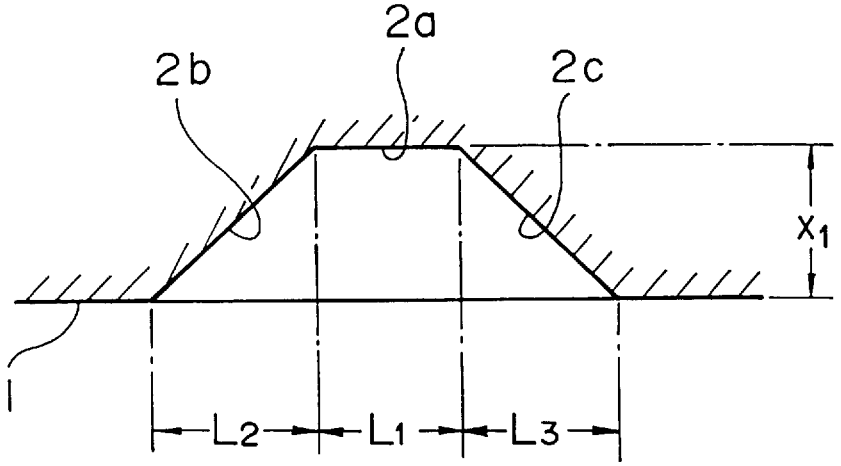

The shapes of a roll caliber 1 and a knotting round caliber 2 will be illustrated below referring to FIGS. 5A and 5B. FIG. 5A shows a cross section of a roll. The radius R of curvature of the roll caliber is 12.0 mm. FIG. 5B shows a knotting round caliber 2 corresponding to the cross section taken along the line VB—VB in FIG. 5A. The knotting round caliber 2 is parallel to the surface of the roll caliber 1. The knotting round caliber 2 comprises a bottom portion 2*a* having a width narrower than the opening of the knotting round caliber, and slant portions 2*b* and 2*c* which are obliquely formed from the opening to the bottom portion 2*a*. The depth $x_1$ from the surface of the roll caliber 1 to the bottom portion is 2.2 mm, the width $L_1$ of the bottom portion 2*a* is 2.0 mm, and each of the widths $L_2$ and $L_3$ of the slant portions 2*b* and 2*c* is 2.2 mm.

Figure 6A:
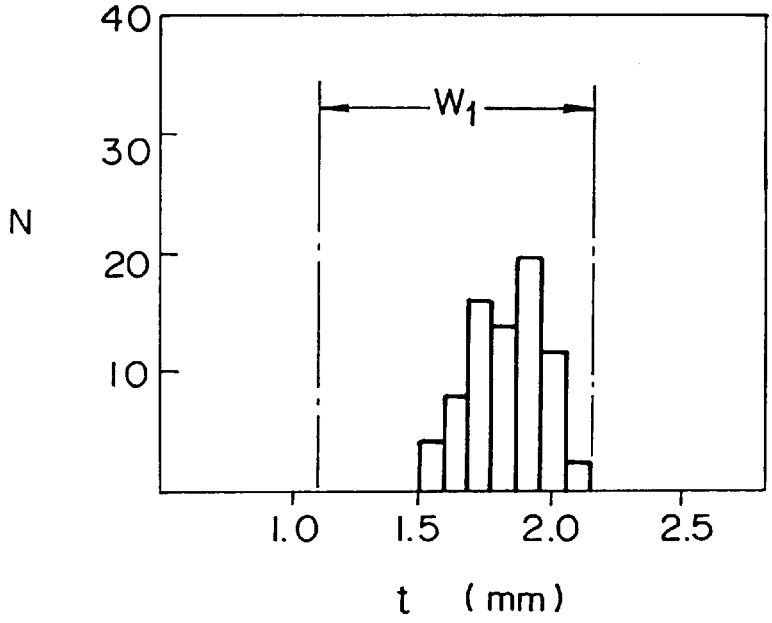
FIG. 6 contains graphs showing the results of measurements of knot heights performed on the concrete-reinforcing steel bars manufactured in the example illustrated in FIG. 2, FIG. 6A showing results of the steel bars having a diameter of 22.0 mm. while FIG. 6B showing results of those having a diameter of 25.0 mm.
Figure 6B:
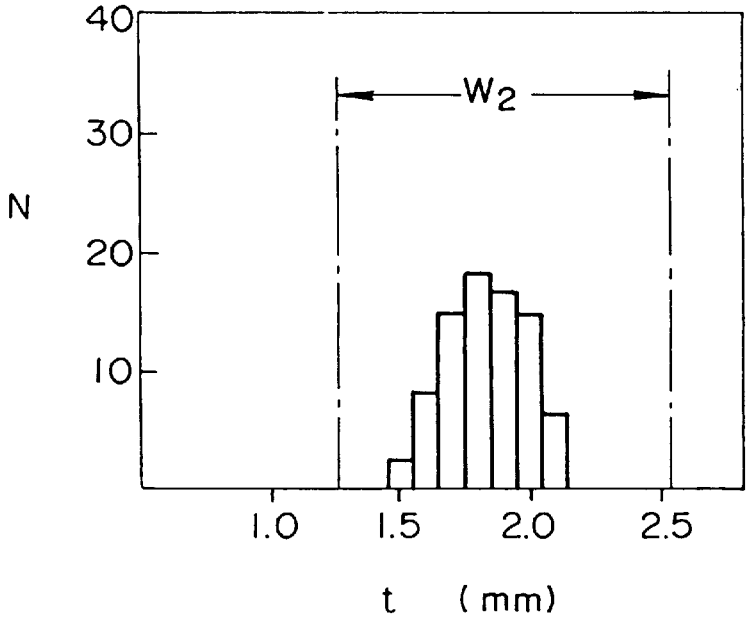

The knot heights were measured on concrete-reinforcing steel bars obtained similarly to the steel bar $I_1$ ($I_1$-type concrete-reinforcing steel bars) detailed above, and those obtained similarly to the steel bar $I_2$ ($I_2$-type concrete-reinforcing steel bars) detailed above. For each measured knot, measurements were performed at four points with an interval of 90° in the circumferential direction, and the average value of the four points was regarded as the height of the knot. The results of the $I_1$- and $I_1$-type concrete-reinforcing steel bars are shown in FIGS. 6A and 6B, respectively.

According to JIS (Japanese Industrial Standard), the tolerance range for knot height $W_1$ of a concrete-reinforcing steel bar having a diameter of 22.0 mm is from 1.1 to 2.2 mm. As is shown in FIG. 6A, all the above-obtained $I_1$-type concrete-reinforcing steel bars satisfy this tolerance range.

Additionally, the tolerance range for knot height $W_2$ of a concrete-reinforcing steel bar having a diameter of 25.0 mm is from 1.3 to 2.6 mm according to JIS. As is shown in FIG. 6B, all the above-obtained $I_2$-type concrete-reinforcing steel bars satisfy this tolerance range.

As is clearly seen from the results, various concrete-reinforcing steel bars which have different diameters while satisfying the required specifications for knot height can be obtained without changing the rolls by using, in the final finishing pass, a rolling stand equipped with two pairs of rolls instead of a conventional rolling stand equipped with only one pair of rolls. In other words, the same rolls can be used in the final finishing rolling stand for obtaining products having different diameters. Accordingly, work required for changing rolls and guides, which is required to change the size of products can be omitted, and labor and time can be saved as compared with conventional methods.

Figure 7:
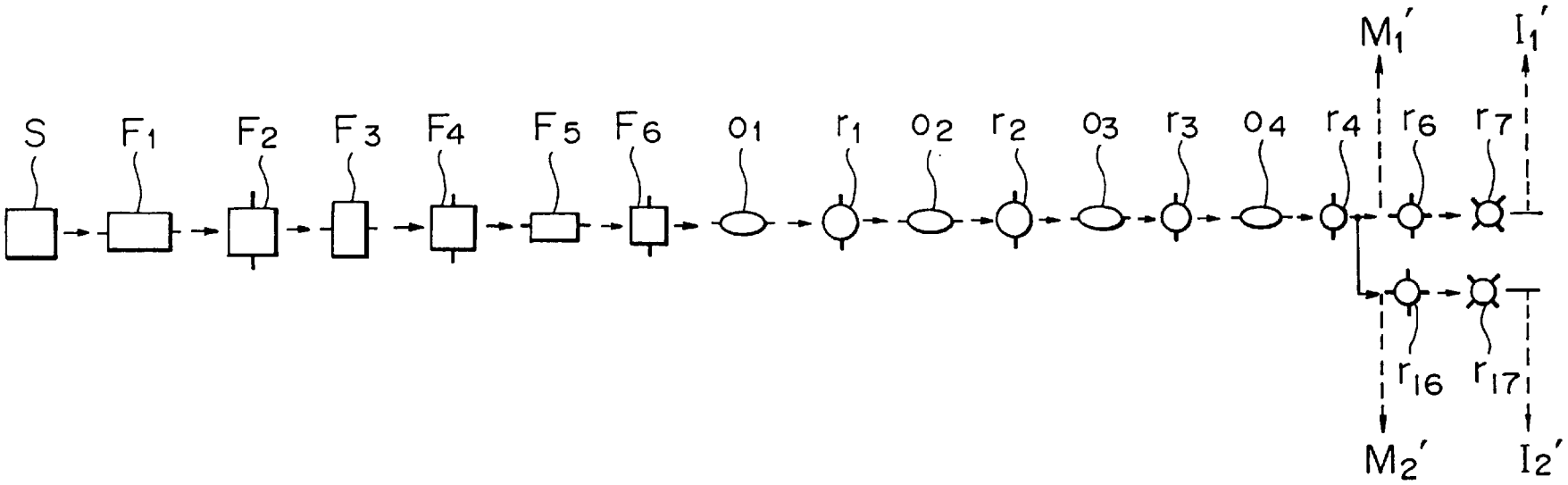
FIG. 7 shows a pass schedule employed in another example for manufacturing concrete-reinforcing steel bars.
Figure 8:
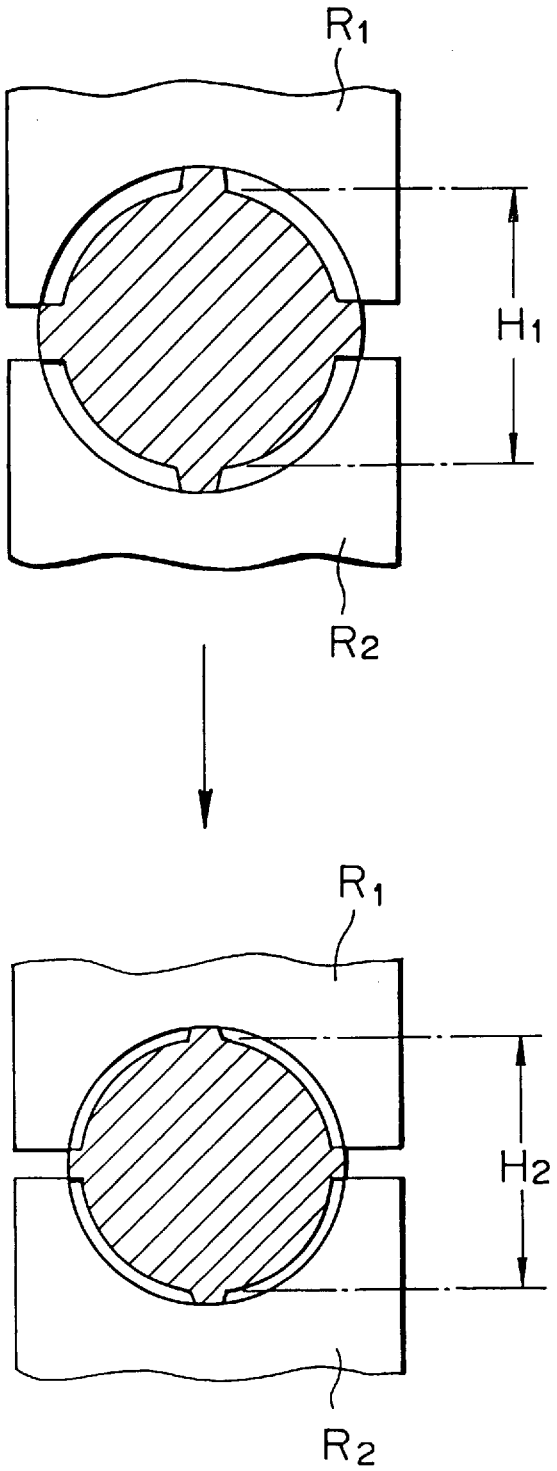
FIG. 8 shows conventional rolls.

Preferably, in addition to the final finishing pass, the finishing pass just preceding the final finishing pass may be carried out using a rolling stand including two pairs of rolls. FIG. 7 shows the pass schedule in an example according to this system. In this example, the pass schedule up to the rolling pass using the round-type rolling stand $r_4$ is the same as that in the aforementioned example. A rolling stand $r_6$ or $r_{16}$ is used in the pass just before the final finishing pass. The rolling stand $r_6$ or $r_{16}$ is a round-type 4-roll rolling stand, corresponding to the rolling stand $r_5$ or $r_{15}$. The rolling stand $r_6$ or $r_{16}$ is used for manufacturing two types of round bar materials $M_1'$ and $M_2'$ which respectively had the same diameters as the above-obtained round bar materials $M_1$ and $M_2$ by altering the roll gaps. Although the pass schedule after rolling with the rolling stand $r_2$ is altered in the aforementioned example shown in FIG. 4 to obtain two types of steel bars having different diameters, only the last two passes are altered in this example, as shown in FIG. 7. Due to this, the labor and time for rolling processes can be greatly reduced. In addition, the size-free range in the rolling process can be further extended by employing three or more rolling stands including two pairs of rolls.

Further, the concrete-reinforcing steel bars to be produced can be of 2-lib type by adjusting the roll gaps between the upper and lower rolls in the final finishing rolling stand to generate overfill which forms libs on the sides of the steel bars produced.

Moreover, the concrete-reinforcing steel bars to be produced can be of 4-lib type by adjusting the roll gaps between the upper and lower rolls, and between the left and right rolls in the final finishing rolling stand to generate overfill which forms libs on the side of the steel bar products.

As illustrated above, according to the present invention, various concrete-reinforcing steel bars satisfying the required specifications for knot height can be manufactured by rolling with the same finishing rolls even if the diameters of the final product steel bars are different. Accordingly, it is not necessary to use alternate final rolls for the final finishing pass each time the diameter of the product is changed. In other words, while the configuration of the final rolls is changed according to the desired diameter of the steel bar, the same final roll is used.

Due to this, the frequency of roll changing can be reduced, and therefore, the labor and time for changing rolls and guides can be saved. Additionally, since the idle time can be shortened, the rolling efficiency can be improved. Further, since the number of necessary roll types can be reduced, the number of rolls kept in inventory can be reduced, and the cost for obtaining rolls and the space for storing rolls can be saved.

Moreover, 4-lib type concrete-reinforcing steel bars, which have rarely been manufactured with conventional 2-roll rolling stands, can readily be manufactured according to the present invention.

As described above, the present invention brings about a large number of advantages for manufacturing concrete-reinforcing steel bars.

What is claimed is:

1. A rolling method for manufacturing a concrete-reinforcing steel bar extending along a central axis, comprising the steps of:

rolling the steel bar in a final finishing rolling stand wherein said final finishing rolling stand includes a first pair and a second pair of opposing rolls, the first pair of opposing rolls having a first roll gap defining a distance between the first pair of rolls, the second pair of opposing rolls having a second roll gap defining a distance between the second pair of rolls, each of the first and second roll gaps being adjustable to move each roll of the first and second pairs of opposing rolls to an overfill generating state wherein the adjacent pairs of rolls are disposed away from each other, such that when the adjacent pairs of rolls are disposed away from each other a lib is formed between each adjacent pairs of rolls on the circumferential surface of the steel bar by generating overfill so that metal will flow into a gap formed between each roll of the adjacent pairs of rolls, the first and second pairs of opposing rolls being adjustable for forming steel bars of varying diameter such that the steel bars of varying diameter can be rolled using the same rolls to obtain dimensional accuracy, each roll having a roll caliber and one or more knotting round calibers on said roll caliber at a predetermined circumferential pitch so as to form knots on the circumferential surface of the steel bar;

exerting a first rolling pressure on the steel bar in a first direction being radially inwardly relative to the central axis by the first pair of rolls to form a first series of knots into the steel bar along the central axis;

exerting a second rolling pressure on the steel bar in a second direction being radially inwardly relative to the central axis by the second pair of rolls to form a second series of knots into the steel bar along the central axis, the first and second directions being orthogonal to each other; and disposing the adjacent pairs of rolls away from each other to generate overfill in the gaps between the adjacent pairs of rolls to form two pairs of oppositely disposed longitudinal libs on the circumferential surface of the steel bar, thereby forming a 4-lib type steel bar.

2. The rolling method according to claim 1, further comprising the step of:

rolling the steel bar in a rolling stand preceding the final finishing rolling stand, the rolling stand including a third pair and a fourth pair of opposing rolls, each roll having a roll caliber, wherein each of the third and fourth pairs of opposing rolls is adjustable for forming steel bars of varying diameter and the third pair of opposing rolls exert a third rolling pressure on the steel bar in a third direction being radially inwardly relative to the central axis and the fourth pair of opposing rolls exert a fourth rolling pressure on the steel bar in a fourth direction being radially inwardly relative to the central axis, the third and fourth directions being orthogonal to each other.

3. The rolling method according to claim 2, wherein at least one of the first and second directions is oriented at approximately 45 degrees relative to one of the third and fourth directions.

4. The rolling method according to claim 1, wherein the each lib of the 4-lib type steel bar is pitched approximately 90 degrees around the circumferential surface of the steel bar parallel to the central axis.

5. A rolling apparatus for manufacturing a 4-lib type concrete-reinforcing steel bar, comprising:

a final finishing rolling stand including a first pair and a second pair of opposing rolls, the first pair of opposing rolls having a first roll gap defining a distance between the first pair of rolls, the second pair of opposing rolls having a second roll gap defining a distance between the second pair of rolls, each of the first and second roll gaps being adjustable to move each roll of the first and second pairs of opposing rolls to an overfill generating state wherein the adjacent pairs of rolls are disposed away from each other, such that when the adjacent pairs of rolls are disposed away from each other a lib is formed between each adjacent pairs of rolls on the circumferential surface of the steel bar by generating overfill so that metal will flow into a gap formed between each roll of the adjacent pairs of rolls, the first and second pairs of opposing rolls being adjustable for forming steel bars of varying diameter, each of the first and second pairs of opposing rolls are adjustable for forming steel bars of varying diameter such that the steel bars of varying diameter can be rolled using the same rolls to obtain dimensional accuracy, each roll having a roll caliber and at least one knotting round calibers on the roll caliber at a predetermined circumferential pitch so as to form uniform knots on a circumferential surface of the steel bar along the central axis.

6. The rolling apparatus according to claim 5, further comprising:

a rolling stand disposed to precede the final finishing rolling stand, the rolling stand including a third pair and a fourth pairs of opposing rolls each having a roll caliber, each of the third and fourth pairs of opposing rolls is adjustable for forming steel bars of varying diameter, each roll of the third and fourth pairs of opposing rolls having a second roll caliber and a second plurality of knotting round calibers the second roll caliber and the second plurality of knotting round calibers having a second predetermined circumferential pitch to form uniform knots on the circumferential surface of the steel bar.

7. The rolling apparatus according to claim 6, wherein the first and second pairs of opposing rolls of the final finishing rolling stand and the third and fourth pairs of opposing rolls of the rolling stand exert rolling pressure on the steel bar, the first pair of rolls exert a first rolling pressure on the steel bar in a first direction being radially inwardly relative to the central axis, the second pair of rolls exert a second rolling pressure on the steel bar in a second direction being radially inwardly relative to the central axis with the first and second directions being orthogonal to each other and the third pair of rolls exert a third rolling pressure on the steel bar in a third direction being radially inwardly relative to the central axis and the fourth pair of rolls exert a fourth rolling pressure on the steel bar in a fourth direction being radially inwardly relative to the central axis with the third and fourth directions being orthogonal to each other.

8. The rolling apparatus according to claim 7 wherein at least one of the first and second directions is oriented at approximately 45 degrees relative to one of the third and fourth directions.

9. A rolling method for manufacturing a concrete-reinforcing steel bar extending along a central axis, comprising the steps of:

rolling the steel bar in a final finishing rolling stand wherein said final finishing rolling stand includes a first pair and a second pair of opposing rolls, the first pair of opposing rolls having a first roll gap defining a distance between the first pair of rolls, the second pair of opposing rolls having a second roll gap defining a distance between the second pair of rolls, each of the first and second roll gaps being adjustable to move each roll of the first and second pairs of opposing rolls to an overfill generating state wherein the adjacent pairs of rolls are disposed away from each other, such that when the adjacent pairs of rolls are disposed away from each other a lib is formed between each adjacent pairs of rolls on the circumferential surface of the steel bar by generating overfill so that metal will flow into a gap formed between each roll of the adjacent pairs of rolls, the first and second pairs of opposing rolls being adjustable for forming steel bars of varying diameter such that the steel bars of varying diameter can be rolled using the same rolls to obtain dimensional accuracy, each roll having a roll caliber and one or more knotting round calibers on said roll caliber at a predetermined circumferential pitch so as to form knots on the circumferential surface of the steel bar;

exerting a first rolling pressure on the steel bar in a first direction being radially inwardly relative to the central axis by the first pair of rolls to form a first series of knots into the steel bar along the central axis;

exerting a second rolling pressure on the steel bar in a second direction being radially inwardly relative to the central axis by the second pair of rolls to form a second series of knots into the steel bar along the central axis, the first and second directions being orthogonal to each other;

disposing the adjacent pairs of rolls away from each other to generate overfill in the gaps between the adjacent pairs of rolls to form two pairs of oppositely disposed libs on the circumferential surface of the steel bar, thereby forming a 4-lib type steel bar; and rolling the steel bar in a rolling stand preceding the final finishing rolling stand, the rolling stand including a third pair and a fourth pair of opposing rolls, each roll having a roll caliber, wherein each of the third and fourth pairs of opposing rolls is adjustable for forming steel bars of varying diameter and the third pair of opposing rolls exert a third rolling pressure on the steel bar in a third direction being radially inwardly relative to the central axis and the fourth pair of opposing rolls exert a fourth rolling pressure on the steel bar in a fourth direction being radially inwardly relative to the central axis, the third and fourth directions being orthogonal to each other, wherein at least one of the first and second directions is oriented at approximately 45 degrees relative to one of the third and fourth directions.

* * * * *